United States Patent [19]

Heimel

[11] 4,227,394

[45] Oct. 14, 1980

[54] PROCESS FOR THE AUTOMATIC MANUFACTURE OF DROP FORGING

[75] Inventor: Othmar Heimel, Behamberg, Austria

[73] Assignee: "Wefoba" Werkzeug-und Formenbau Gesellschaft mbH & Co., KG, Steyr, Austria

[21] Appl. No.: 931,920

[22] Filed: Aug. 8, 1978

[30] Foreign Application Priority Data

Sep. 26, 1977 [AT] Austria ..... 6850/77

[51] Int. Cl.[3] ..... B21D 22/00

[52] U.S. Cl. ..... 72/356; 72/361; 72/405; 76/10; 76/114

[58] Field of Search ..... 72/356, 405, 361, 421; 76/10, 101 D, 114

[56] References Cited

U.S. PATENT DOCUMENTS

| | | | |
|---|---|---|---|
| 1,865,412 | 6/1932 | Geist et al. | 72/405 X |
| 2,442,859 | 6/1948 | Ogden | 72/405 X |
| 3,159,198 | 12/1964 | Sutch | 72/405 X |
| 4,048,838 | 9/1977 | Faymonville | 72/405 |

FOREIGN PATENT DOCUMENTS

| | | | |
|---|---|---|---|
| 440469 | 5/1925 | Fed. Rep. of Germany | 76/114 |

*Primary Examiner*—Leon Gilden
*Attorney, Agent, or Firm*—Fleit & Jacobson

[57] ABSTRACT

Apparatus for the automatic manufacture of drop forgings, particularly wrenches, from split-off and stamped workpieces comprises prebending means having a stationary bending jaw and a bending jaw which is movable in a horizontal plane, transfer means, and a power hammer which is disposed below the prebending means and has forging dies which are oppositely movable in a horizontal plane.

9 Claims, 4 Drawing Figures

PROCESS FOR THE AUTOMATIC MANUFACTURE OF DROP FORGING

SUMMARY OF INVENTION

Apparatus for the automatic manufacture of drop forgings from split-off and stamped workpieces, which are prebent by bending means and are forged by oppositely movable forging dies in a power hammer, which operates parallel to the bending apparatus.

This invention relates to a process for the automatic manufacture of drop forgings, particularly for the manufacture of wrenches from split-off and stamped workpieces, and apparatus for carrying out the process.

It has been usual for a long time to make articles having large differences in cross-section in their longitudinal direction, particularly wrenches, from split-off workpieces which are made from plates by stamping.

The use of split-off workpieces permits of a favourable distribution of material so that the parts can be forged with a small amount of waste. Directly adjoining sections are severed (split off) without waste from strip and are then bent in the plane of the workpiece to form a blank which can then be inserted into the forging dies.

The split-off and stamped workpieces were previously heated, in most cases in a gas-fired tunnel furnace, and were then ma-nually gripped with tongs and drop-forged by power hammers.

Attempts to provide an automatic process using industrial handling robots in conjunction with vertical drop forging machines of vertical type have failed because the workpiece end portions held by the tongs lack a sufficiently high stability.

The same remark is applicable to the impacter forging machine of Chambersburg Engineering, U.S.A., in which the split-off workpieces hang vertically from tongs and are advanced in steps from the cavity to die cavity by the horizontally blowing impacter forging machine.

Another difficulty involved in the previous attempts resides in that the energy required for prebending the split-off workpieces is much smaller than the impact energy required for the actual forging operation and that blows requiring such greatly different energies (1:20) can hardly be performed by one and the same machine precisely in an automatic cycle.

It is an object of the invention to avoid the disadvantages of the conventional processes. This is accomplished according to the invention in that the prebending of the sections of material to form the blank is effected before the forging operation.

The invention relates also to apparatus comprising prebending means having a stationary bending jaw and a bending jaw which is movable in a horizontal plane, transfer means and a power hammer which is disposed below the prebending means and comprises dies which are oppositely movable in a horizontal plane.

Further details of the invention will now be explained with reference to the drawings, which are simplified representations of an illustrative embodiment of the apparatus.

Figure 1:
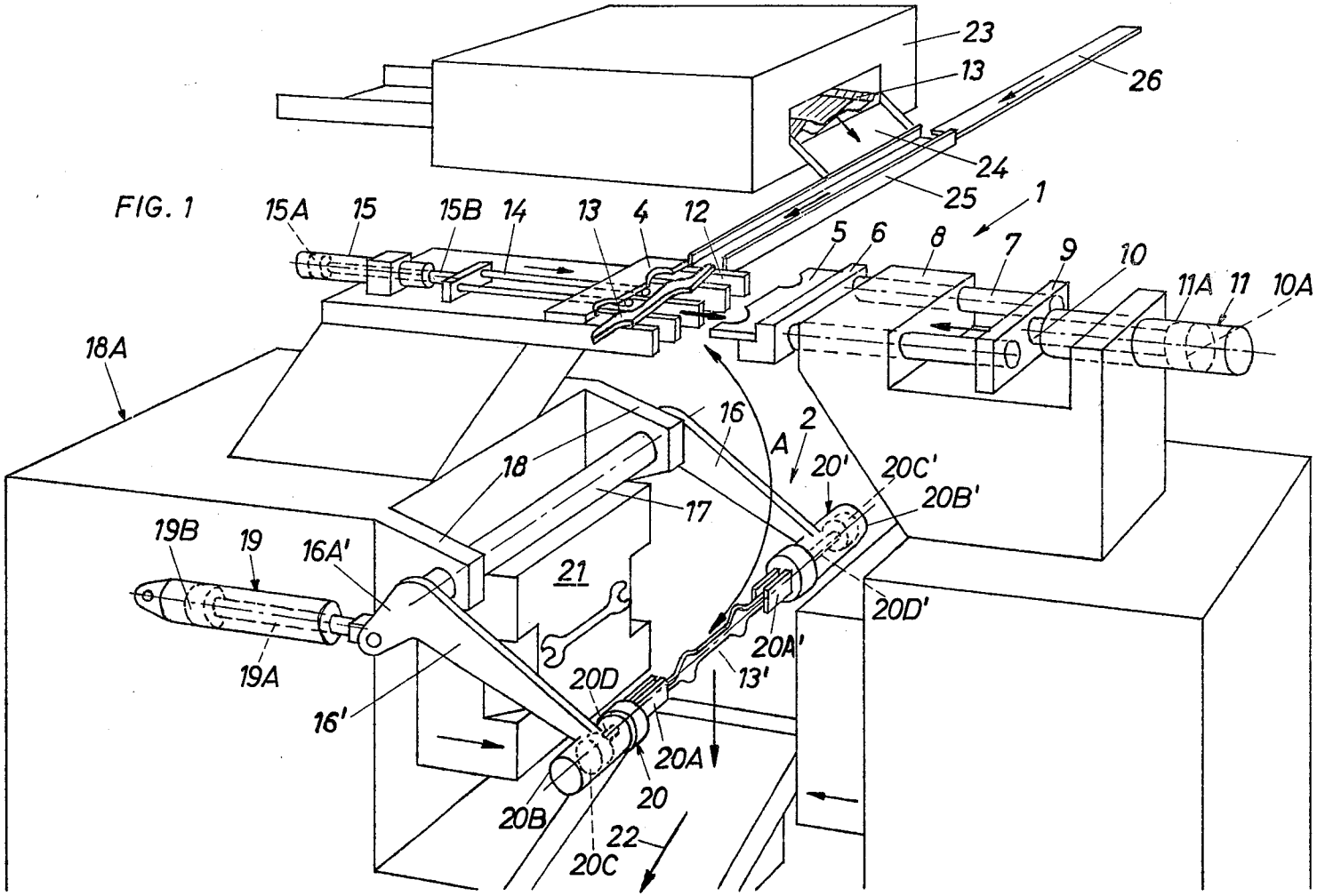
Figure 2:
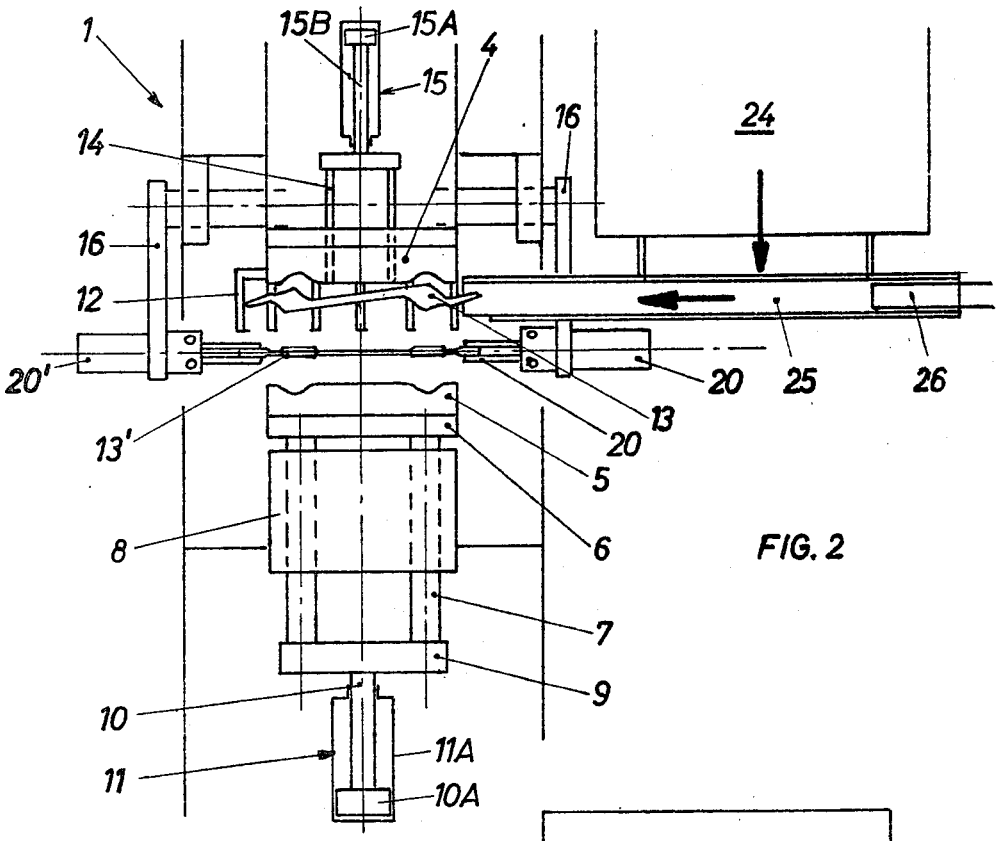
Figure 3:
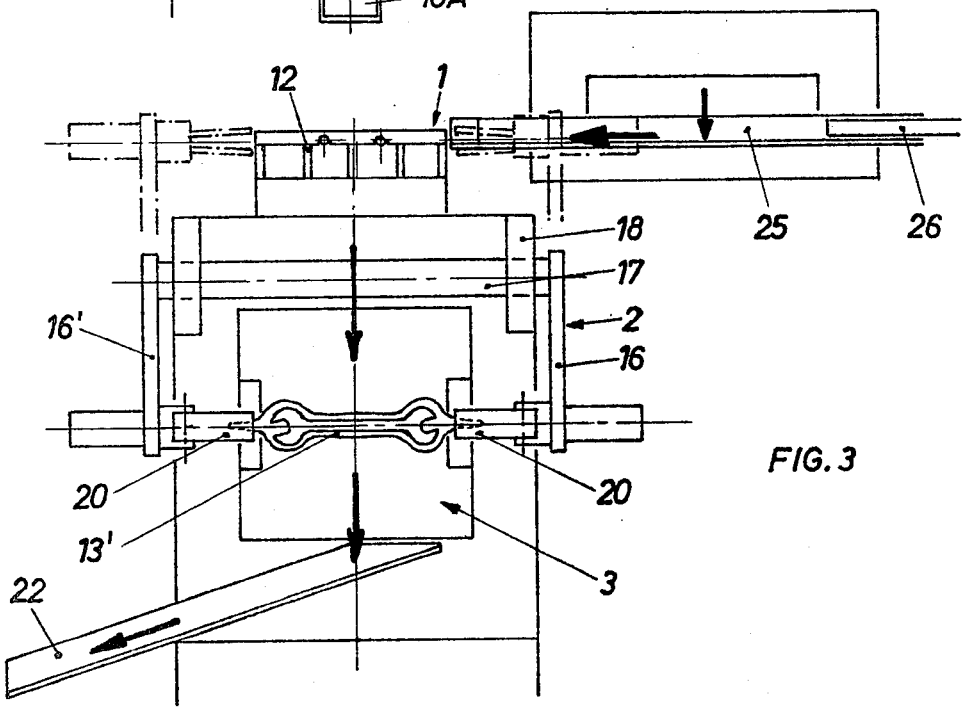

FIG. 1 is a simplified view showing the entire apparatus,

FIG. 2 a top plan view,

FIG. 3 a longitudinal sectional view, and

Figure 4:
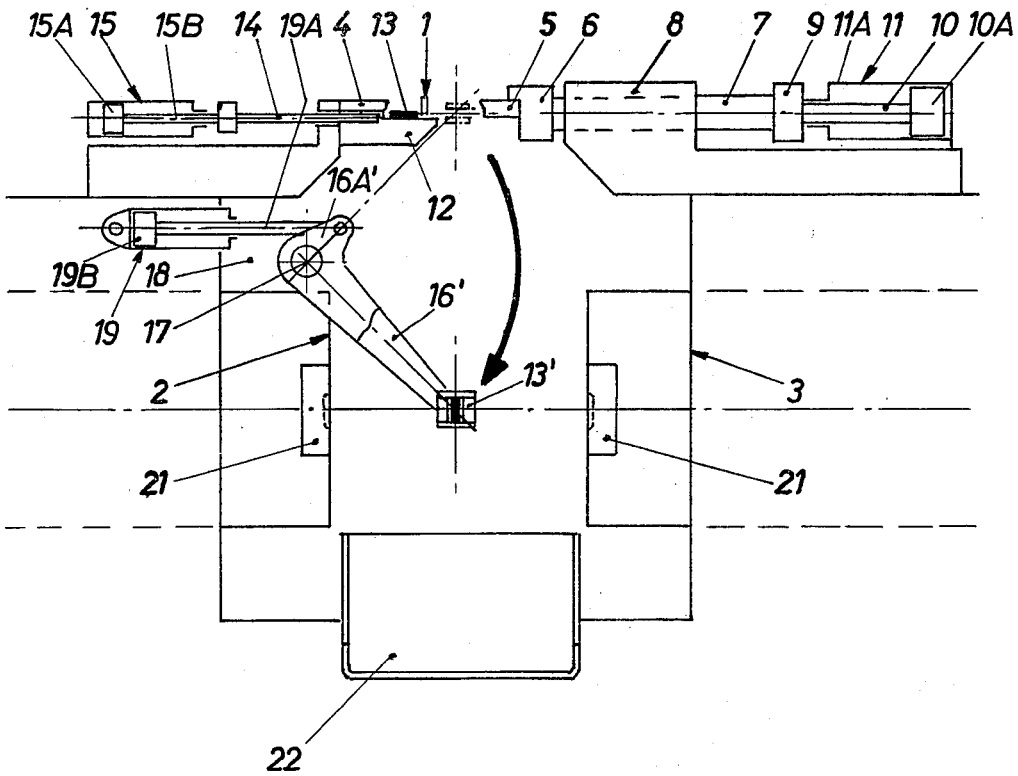

FIG. 4 a front elevation showing the apparatus.

The three main parts of the apparatus consist of the prebending means 1, the transfer means 2, and the forging machine (power hammer) 3.

The prebending means 1 consist of a stationary bending jaw 4 and a bending jaw 5 which is carried by a holder 6 and reciprocable in a horizontal plane. The holder 6 is carried by two rods 7, which are slidably guided in a guide block 8. The rods are connected at the other end by a yoke 9, to which a piston rod 10 of a hydraulic actuator 11 is connected. In the cylinder 11A of the actuator 11, fluid pressure is applied to a piston 10A mounted on the piston rod 10 in the working direction.

A guideway for the workpiece 13 is disposed below the stationary jaw 4 and consists of a grating 12 in order to minimize the heat losses. A plunger 14 is associated with that guideway and is adapted to be driven by a pneumatic actuator 15 having a piston 15A and a piston rod 15B. By means of the plunger, the workpieces 13 which have been severed from a strip and prebent to form blanks 13' are fed into the relocating means 2.

The transfer means comprise two pivoted arms 16, 16', which are rigidly mounted on a common shaft 17. The pivoted arm 16' consists of a bell crank lever. The shaft 17 is mounted in two eyelets 18 of the machine frame 18A. The bell crank lever 16' has a shorter lever arm 16A', which is connected to a piston rod 19A of a hydraulic actuator 19, in which fluid pressure is applied to a piston 19B carried by the piston rod 19A. Each of the transfer arms 16, 16' is provided at its free end with a gripper 20 or 20', which has resilient jaws 20A and 20A', which are operable by means of pneumatic actuators 20B, 20B'. These grippers may be connected to a stop motion, not shown, which stops the machine when the jaws have failed to grip a blank within the predetermined period of time. As is indicated by the arrow A, the transfer arms move through 90° so that each prebent blank lying on the horizontal grating 12 is rotated by the jaws through 90° to lie in a vertical position as it arrives at the forging dies of the forging machine 3.

The forging machine 3 is preferably a horizontal impacter forging machine as described in the applicant's U.S. patent application Ser. No. 839,434. The two forging dies 21 are horizontally movable in mutually opposite directions. A troughlike chute 22 is disposed below the forging dies.

The entire apparatus is controlled by an electronic program control system which can cause the apparatus to perform one to three drop forging blows per workpiece.

The mode of operation of the apparatus or the way in which the process is performed will now be described:

Workpieces 13 are heated to the working temperature in the pusher type furnace 23 and fed on the ramp 24 to a feed trough 25, from which the feed pusher 26 pushes individual workpieces onto the grate 12 between the jaws 4 and 5. When the workpiece has reached its end position, the movement of the jaw 5 is initiated so that the latter forces the workpiece against the jaw 4 and thus bends the workpiece to such a shape that it can be inserted into a forging die. As the jaw 5 swings back, the transfer arms 16, 16' swing upwardly while their grippers are open and the pusher 14 pushes the prebent blank 13' between the jaws 20 of the two grippers. The grippers are then closed to grip the blank 13' at its tapered end extensions. The transfer arms then swing down to move the blank to the proper position between the two forging dies 21 and to rotate the blank through 90° so that its longitudinal center plane is now vertical and at right angles to the direction of movement of the forging dies. The blank 13' is now forged by one to three blows of the forging dies. During the forging operation, the next workpiece 13 is pushed between and prebent by the bending jaws 4 and 5. As the forging operation has been completed, the grippers at the ends of the transfer arms are opened and the forging falls onto the trough 22 and is moved thereon to a receiving station.

The grippers are then opened and swung up to initiate the next cycle.

Because the jaws 20 of the gripper can yield elastically, the gripper will not be damaged when the blank is not properly positioned relative to the forging dies.

When dies having a plurality of die cavities lying one over the other are employed, the transfer means may be designed to be vertically movable in steps so that it can shift the blank to the next die cavity between the blows of the dies.

The invention affords the following advantages over the previously known apparatus and processes:

1. The prebending of the split-off workpieces is not performed by the hammer but in the feeding mechanism. The bending stroke is performed by a hydraulic actuator at high speed at a time when the forging machine can forge a workpiece which has been prebent during the preceding cycle so that the plant can operate with a high throughput.

2. Whereas the workpieces were gripped only at one end in the previous practice, they are now gripped at both ends and are moved in a horizontal position by two opposite grippers from the bending station to a position between the horizontally striking dies of an impacter forging machine. The small additional material required to enable the workpiece to be gripped at the second end can be compensated by a saving of material throughout the workpiece, which is very exactly positioned between the forging dies. Because two grippers are used in conjunction with a horizontally striking impacter forging machine, the forgings do not hang down in an undesirable manner.

3. The prebending outside the forging machine enables a more favorable manufacture of the forging die. The die inserts may be relatively small and shallow and the die cavities can be repeatedly readjusted without difficulty. Die inserts having a plurality of die cavities may be used, if desired, as is the present practice with manually controlled forging machines.

I claim:

1. Apparatus for the automatic manufacture of drop forgings comprising prebending means having two cooperating jaws facing each other and operable to prebend a slit off and stamped workpiece, at least one of the jaws being movable towards the other in a horizontal direction;

support means positioned below one of said two cooperating jaws for supporting a workpiece, said support means including a grate having a plurality of horizontally spaced apart members for supporting the workpiece;

transfer means for transferring the prebent workpiece, said transfer means including a pair of pivoted transfer arms having grippers on ends of the arms for gripping and releasably holding ends of the prebent workpiece, the transfer arms being pivotable so that the grippers engage both ends of the supported prebent workpiece, the gripped workpiece being rotated by said transfer arms from a horizontally oriented position to a vertically oriented position; and a power hammer for forging a transferred and gripped prebent workpiece and having horizontally movable dies for forging the prebent workpiece to a finished product.

2. Apparatus as set forth in claim 1, further comprising a plunger operatively associated with said prebending means for ejecting a prebent workpiece from one of the jaws of said prebending means and for transferring the ejected prebent workpiece to said transfer means.

3. Apparatus as set forth in claim 1, wherein said prebending means comprise a fixed jaw and a jaw which is movable in a horizontal direction.

4. Apparatus as set forth in claim 3, wherein the power hammer is disposed below the prebending means.

5. Apparatus as set forth in claim 1, wherein the pivoted transfer arms move in unison and each has at its free end a gripper provided with resilient jaws for gripping the prebent workpieces at tapered ends.

6. Apparatus as set forth in claim 1, wherein said jaws of the prebending means are movable parallel to said dies of said power hammer.

7. Apparatus as set forth in claim 5, wherein each of said grippers of said pivoted transfer arms is adapted to be controlled by a piston rod of a piston which is operable by fluid pressure.

8. Apparauts as set forth in claim 5, wherein at least one of said pivoted transfer arms consists of a bell crank lever having lever arms of unequal length, the longer lever arm carries said gripper, and the shorter lever arm is pivoted to a piston which is operable by fluid pressure.

9. Apparatus as set forth in claim 2, wherein said movable jaw of said prebending means is connected to a rod which carries a piston which is horizontally movable under the action of fluid pressure.

* * * * *